United States Patent [19]

Pennington

[11] Patent Number: 4,658,853

[45] Date of Patent: Apr. 21, 1987

[54] ANTI-LEAK VALVING SYSTEM

[75] Inventor: Rodney L. Pennington, Morris Township, Morris County, N.J.

[73] Assignee: Regenerative Environmental Equipment Co., Inc., Morris Plains, N.J.

[21] Appl. No.: 690,059

[22] Filed: Jan. 9, 1985

[51] Int. Cl.[4] ..... F16K 1/226; F23G 7/06; F01N 3/10; F01N 3/26

[52] U.S. Cl. ..... 137/240; 110/203; 110/204; 110/207; 110/212; 137/246.22; 422/173; 422/175; 422/177

[58] Field of Search ..... 110/203, 204, 206, 207, 110/210, 212, 214; 137/238, 240, 246, 246.12, 246.22; 422/173, 175, 177; 251/305, 306, 308

[56] References Cited

U.S. PATENT DOCUMENTS

| | | | |
|---|---|---|---|
| 2,630,293 | 3/1953 | Smith | 137/240 |
| 3,895,918 | 7/1975 | Mueller | 422/175 |
| 4,140,147 | 2/1979 | Van't Sant | 137/240 |
| 4,248,841 | 2/1981 | Benedick | 422/175 |
| 4,252,070 | 2/1981 | Benedick | 422/175 |
| 4,252,999 | 2/1981 | LoBue | 137/240 |
| 4,335,738 | 6/1982 | Nassir | 137/246.22 |
| 4,380,246 | 4/1983 | Casale . | |
| 4,383,546 | 5/1983 | Walters, Jr. | 137/240 |

FOREIGN PATENT DOCUMENTS

| | | |
|---|---|---|
| 447244 | 5/1936 | United Kingdom . |
| 1300685 | 12/1972 | United Kingdom . |
| 1436092 | 5/1976 | United Kingdom . |
| 1458455 | 12/1976 | United Kingdom . |
| 1537649 | 1/1979 | United Kingdom . |
| 2006924 | 5/1979 | United Kingdom . |
| 2055457 | 3/1981 | United Kingdom . |

*Primary Examiner*—George L. Walton
*Attorney, Agent, or Firm*—Paul & Paul

[57] ABSTRACT

A butterfly-type step subassembly includes a substantially planar valve disc member having a peripheral groove formed in opposite surfaces thereof. Projecting inwardly from the internal walls of the subassembly housing are two non-coplanar, generally semicircular valve seat members having passageway(s) in them communicating outside the housing with a source of purified gas(es). The passageways terminate interiorly in apertures in respective recesses in the seat members positioned to be brought into communication with said grooves when said valve disc member is in substantial contact with said seat members. Means are provided to supply said purified gas(es) to said passageways in response to the movement of said planar disc member to the nominally closed position so that said gas(es) flow into the contact region between the disc and seat members under sufficient pressure to prevent said effluent from flowing through said valve when nominally closed.

20 Claims, 6 Drawing Figures

38
P
35
TO EXHAUST
36
49
40
46
20
43
33
3a
37
43a
33a
33f
51
33g
3b
33m
33d
52
44a
23, 33
44
50
48
47
5
33h
33j
33l
4

ANTI-LEAK VALVING SYSTEM

BACKGROUND OF THE INVENTION

A. Field of the Invention

This invention relates to improvements in valving systems and, in particular, to systems for preventing leakage of fluids past butterfly step valves.

B. Prior Art

Valving systems employing butterfly valves or step-valves of the butterfly type are used widely throughout industry for many different applications. One application is for thermal regeneration apparatus such as that shown in U.S. Pat. No. 3,895,918 issued to James H. Mueller on July 22, 1975. In that system, a number of heat-exchange sections are arranged about and in communication with a central, high-temperature combustion chamber. Each heat-exchange section includes a heat-exchange bed with a large number of refractory elements or "stones" confined within a heat-exchange bed by inward and outward perforated retaining walls. An industrial effluent to be purified is applied to an inlet duct ring which has branch ducts that distribute the effluent to selected ones of the heat-exchange sections whenever its associated inlet valve is open. In such a case, the effluent traverses the heat-exchange bed which has a very hot front or inner wall that abuts the extremely high temperature produced within the central combustion chamber. The opposite perforated wall of the heat-exchange bed is much cooler being more remote from the central chamber and there is a gradient from high to low temperature between the two walls.

All of the heat-exchange sections are also coupled by branch conduits to an exhaust duct ring, the ring itself being connected to an exhaust fan that draws the gaseous contents of the exhaust ring out and applies them to an exhaust stack or equivalent.

Initially, the effluent traverses a first heat exchange bed in one of the heat exchange sections after passing through an open inlet valve (the outlet valve of that same section being kept closed) and then is drawn through the central combustion chamber where it is purified by high temperature oxidation. It is then sucked through at least a second heat exchange bed to whose stones the purified combustion products lose their very high heat. In the second heat exchange section, during the same interval, the inlet valve remains closed whereas its outlet valve leading to the exchaust ring is open.

When the next cycle begins, however, the second heat exchange section, which has been heated during the previous cycle by the exiting effluent, may have its role reversed (by appropriate control of its valves) so as to function as an inlet heat-exchanger. Conversely, the first heat-exchange section may have its role reversed to function as an outlet heat-exchanger. Thus, in the next cycle, the first heat-exchange section will have its outlet valve turned on and its inlet valve closed, whereas the second heat-exchange section will have just the opposite valve condition. Before the next cycle begins, however, there is an intermediate hiatus interval in which both valves of the first section (inlet and outlet) will be turned off to permit any residual effluent in that section to be drawn off through the combustion chamber. This is to prevent the possibility that this residual unpurified effluent will be drawn directly into the outlet exhaust ring without traversing the heat-exchange bed in the first section when the valves in that first section are reversed in condition during the second cycle. This residual effluent would also have escaped traversal of the central combustion chamber and the heat-exchange bed in the second heat exchange section. Consequently, there would be a risk of emission of noxious or dangerous gases into the atmosphere via exhaust.

The valves used at the inlet and outlet of the respective heat-exchange sections are often metal-to-metal, mainly because of the high temperatures involved. For various reasons, including possible excessive heat at times, the seal afforded by these valves when in the nominally "closed" condition, may be less than perfect. As a result, it is possible, in the hiatus between consecutive cycles of operation, that effluent from the industrial process may leak past a closed outlet valve or closed inlet valve, when that valve is nominally closed. The effluent might go directly into the exhaust duct and out through the stack to the ambient atmosphere or to whatever point in the system that supposedly purified and cooled exhaust gases may be recycled.

While such leakage in many cases may not be very significant, occasions occur in which the effluent has highly toxic or corrosive components. Even the slightest amount of leakage of these components into the ambient atmosphere, or to an exhaust-recycle point, may pose dangers to operating personnel, to the public outside of the plant and cause anti-pollution authorities to take action.

Another effect of such leakage may be to damage the valves downstream because of their corrosive or other chemically active components or may damage the exhaust fan itself since those harmful elements have not been removed by the combustion chamber.

Still another effect of this partial leakage is the reduction of the overall thermal efficiency of the system.

Measurement of leakage of valves is an arduous task. Once a valve has been installed, there is no very practical way to measure the leakage before the valve is put to actual operating conditions. In advance of installation, the testing of leakage of an individual valve on a test stand using ambient air is not very valid because ambient air is at a small fraction of the operating gas temperatures in actuality. Simulation of actual operating temperatures would require elaborate heat-exchange equipment and other expensive equipment. Furthermore, even if a practical test could be devised, each one would have to be individually tested since shop machining practices and allowable tolerances may be unsatisfactory. Two valves supposedly having the same leakage rate may, in fact, have sufficiently different rates that controlled leakages of 1% or less cannot be guaranteed in specifications or attained in comply with anti-pollution laws.

Two ways are known of combating this leakage. One of them involves the use of two valves in series at the inlet and outlet to each heat-exchange bed. This reduces the pressure differential across each valve and thereby the rate and volume of leakage. This is described and claimed in U.S. Pat. No. 4,252,070 to Edward H. Benedick. While this method may be useful in reducing leakage, it does require the use of a double number of valves and appurtenant controls.

A second approach is set forth in U.S. Pat. No. 4,248,841 also to Edward H. Benedick in which relatively pure gas, such as the purified effluent, is fed back to blanket the upstream side of the valves thereby tending to minimize the chances that unpurified effluent can pass the valve.

It is therefore among the objects of the present invention to:

1. Provide a system for minimizing or preventing leakage of unpurified effluent across valves in incineration systems of the type described.

2. Provide an anti-leak system for incineration apparatus which is less expensive than other known systems.

3. Provide a system for preventing the flow of a fluid (gas) past the valve of a valve assembly when said valve is in the nominally closed position.

4. Provide a system for maintaining the thermal efficiency of the apparatus while preventing leakage of unpurified effluent to exhaust.

5. Provide a heat-regenerative incineration system that does not require the use of dual valving and appurtenant controls to maintain extremely low levels of unpurified effluent sent to exhaust.

SUMMARY OF THE INVENTION

An anti-leak butterfly-type valve subassembly having a planar member with at least one peripheral groove formed on at least one principal surface thereof. In the nominally closed valve position, the groove(s) are positioned to be in communication with grooves in corresponding valve seat members inside the subassembly housing. These grooves are the terminations of passageways that are adapted to be coupled to sources of pressurized gas(es) for preventing the flow of gas(es) past said planar member when the valve is nominally closed.

DETAILED DESCRIPTION OF THE DRAWINGS

Figure 1:
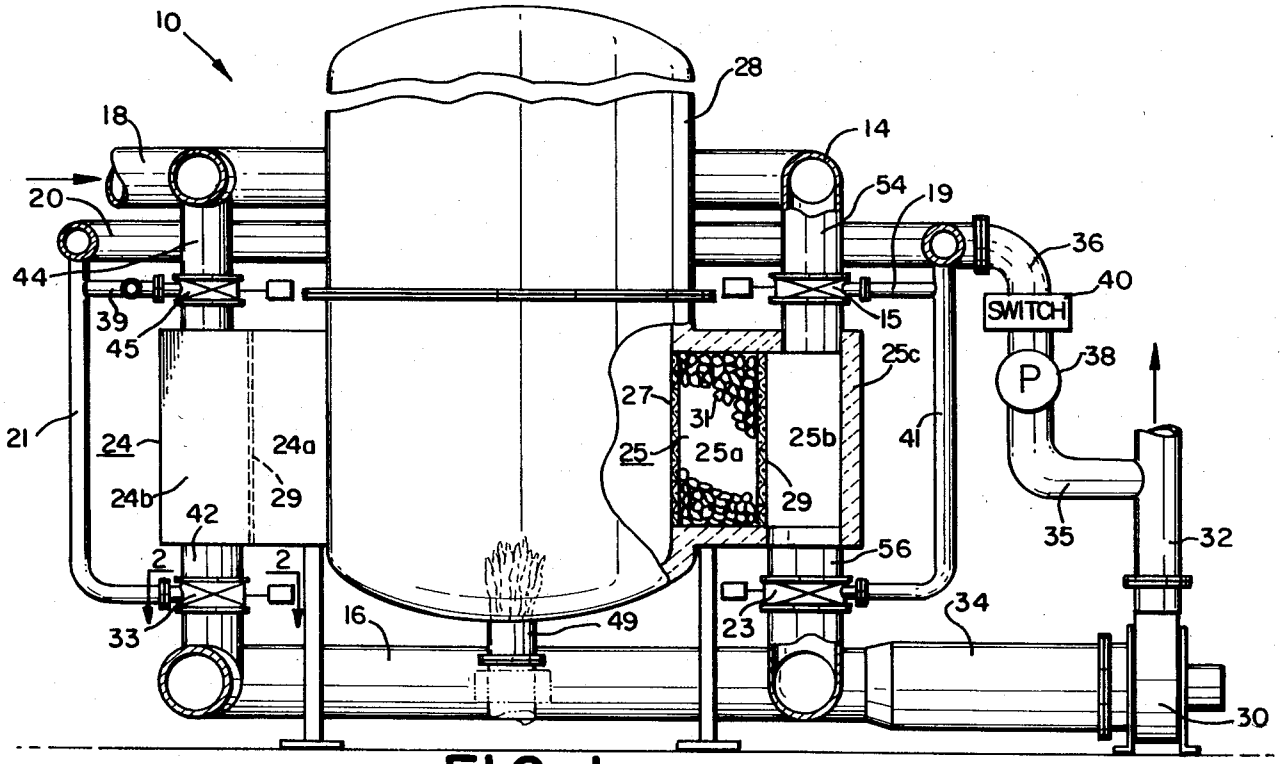
FIG. 1 is a side elevation view, partly crosssectional and schematic, of the general type of apparatus with which the present invention may be used.

Referring now to FIG. 1, a representative environment of the present invention is depicted. It is an incineration apparatus 10 for anti-pollution control such as the "RE-THERM" thermal regeneration equipment manufactured and distributed by Regenerative Environmental Equipment Co., Inc. of Morris Plains, N.J. This apparatus includes an inlet duct 18 which communicates with the output of an industrial process (not shown) that produces a noxious or otherwise undesirable effluent that is to be oxidized. The inlet duct 18 communicates with an upper duct ring 14, that, in turn, has a plurality of vertical branch ducts 44 and 54. The latter respectively communicate with a plurality (3, 5, 7, etc.) of heat exchange sections such as the sections 24 and 25. They are, in certain embodiments, disposed equiangularly around a central combustion chamber 28. All of the sections are constructed substantially the same, only two of them being depicted to illustrate the effluent-gas flow path in typical cycles of operation. Each section has a heat-exchange bed 25*a* comprised of a plurality of ceramic elements 31 which may be, for example, saddle-shaped "stones" retained by an inner apertured wall 27 and at the rear by an apertured wall 29. The inlet vertical ducts 44, 54 communicate with the spaces 24*b*, 25*b* outwardly of the outer retaining walls 29, but inwardly of the outer wall or sheath 25*c* of each section.

During the first cycle, the effluent is fed to the left heat-exchange section 24 via an inlet valve subassembly 45, which is in the open condition, into the space 24*b*. During this time, the outlet valve subassembly 33, which also communicates with the space 24*b* and is in the duct 42 leading from section 24 to the outlet ring 16, is nominally closed. During this first cycle, right upper inlet valve subassembly 15, which is in the vertical inlet duct 54 to section 25, is nominally closed thereby preventing the effluent from entering the space 25*b*. However, the lower outlet valve subassembly 23 is operated in the open position. Thus, any gases drawn by suction through combustion chamber 28 and bed 25*a* into the space 25*b* will leave the latter space via the vertical duct 56 coupled thereto and enter the outlet or exhaust ring 16. The exhaust ring duct 16 is connected by duct 34 to an exhaust fan 30 which has an output to stack 32. Fan 30 creates suction in the exhaust ring 16 and in its vertical feeder ducts such as 42 and 56 so that the effluent is drawn first through section 24, then through the combustion chamber 28, then through section 25.

Section 25 has its stones 31 heated by its direct exposure to flame from burner 49 in combustion chamber 28 and from the super-heated effluent from the latter on its way to and through section 25. After all of the heat-exchange sections have been involved in at least one cycle, their stones 31 retain heat from radiation from the heat produced within the central chamber 28 and from traversal of the gases through thm. Thus, the incoming effluent is pre-heated as it moves through an inlet heat-exchange section. Passage of the effluent through the combustion chamber raises the effluent to a very high temperature, perhaps in the 1200° F.-1500° F. range. This high temperature effectively oxidizes or causes thermal decomposition of any pollutants remaining in the output of the industrial process. The passage of the purified effluent into and through the right-hand bed 25 causes much of its elevated heat to be imparted to the stones therein so that it arrives cooled-down in the space 25*b* in the 400° F.-500° F. range, for example.

There is time between successive cycles in which unpurified effluent present in the spaces 24*b* or 25*b* below the nominally-closed upper inlet valves 45 and 15 can be sucked out through the lower outlet or exhaust valve subassemblies 33 and 23 and into the exhaust ring 16, short-circuiting purification in the combustion chamber. In the case of toxic gas such as vinyl chloride, this can cause damage to property and injury to humans.

In accordance with the present invention, the lower left valve subassembly 33 and any other valves (such as 23) in the system, which are in the gas flow leading directly to the exhaust ring, have a novel construction. They are employed with an auxiliary pressurized gas system to prevent cooperatively gas from passing those valves when they are in the nominally-closed position. In accordance with the present invention, the flow of the effluent past the valve member of a step-valve assembly is substantially prevented by introducing a second relatively pure gas (or combination of gases such as air) under pressure between the nominally contacting peripheral portions of the valve and the valve seat members.

Figures 2, 3A, 3B, 4, 5:
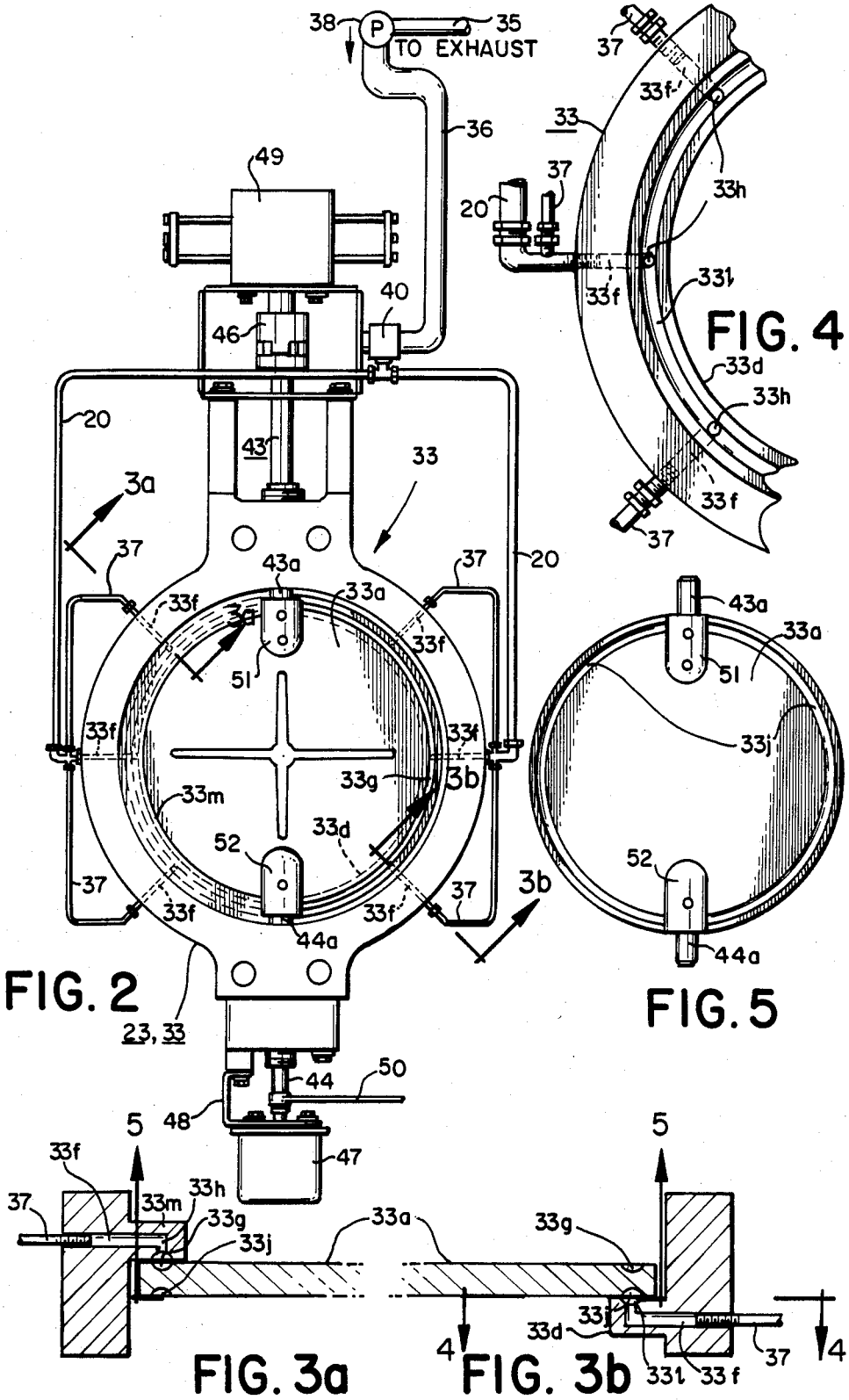
FIG. 2 is a downward, vertical view taken along the sight line 2—2 of FIG. 1 in the direction indicated.
FIGS. 3*a*, 3*b* are enlarged, dual-section views taken along the pair of section lines 3*a*—3*a*, 3*b*—3*b* in FIG. 2 in the direction indicated.
FIG. 4 is a sectional view taken along the section line 4—4 in FIG. 3.
FIG. 5 is a view of part of the apparatus shown in FIG. 4 taken along the sight-line 5—5 of FIG. 4.

In the particular embodiment shown in the drawings (FIGS. 1 through 5) there is a lower valve 33 subassembly which, during the time that section 24 is in the inlet mode of operation, is nominally closed. This lower left valve 33 subassembly comprises a disc-like valve member 33*a* half of whose peripheral portion shown in FIG. 3*a* is constructed to seat or abut the semi-circular seat member 33*m* when the valve assembly is nominally closed. The opposite peripheral portion of the disc member 33 is built to seat on the opposite semi-circular seat member 33*d* as shown in FIG. 3*b*. Disc 33*a* has an upper continuous peripheral circular groove 33*g* and a corresponding lower peripheral groove 33*j*.

As seen in FIGS. 2, 3 and 4, there is formed in each of the seat members 33*m* and 33*d* a groove 33*k* having holes 33*h* which communicate via respective passageways 33*f* with tubes 37. The latter are connected to a source of relatively pure or purified air via a solenoid switch 40, duct 36 and auxiliary exhaust recycle duct ring 20. Such a source may be, for example, a pump 38 coupled via ducts 35 and 36 between the exhaust stack 32 and ring 20 for pumping back from the stack some cooled purified effluent therein. The supply of the recycled exhaust is controlled by the switch 40 which is coupled to a rotation-sensing element such as a limit switch 47 coupled to the main shaft 44 to which the disc valve member 33*a* and pointer 50 are connected.

When the valve subassembly nominally closes, the switch 47 senses this condition and signals the switch 40 to open and the pump 38 to start pumping. The pressurized and purified effluent from the stack 32 is then pumped via ducts 35 and 36 into the recycle exhaust ring duct 20. From there the effluent goes to the tubes 37 that supply the passageways 33*f*, the holes 33*h*, and the grooves 33*k*,33*l* in each seat member 33*m*, 33*d*.

When the introduction of the pressurized cooled and purified effluent into the valve seat grooves 33*k*, 33*l*, if there is an incomplete closure of the disc 33*a* where its peripheral portion should make sealing contact with the associated seat members, the purified effluent will prevent the effluent from the industrial process from leaking past the valve disc. The valve subassemblies may all be equipped with this invention, or just a particular one or ones.

In the manufacture of the improved valve subassembly, the grooves 33*g*, 33*j* in the disc may be formed from a single 360° cutting or milling step. The grooves are effectively bisected, however, by the passage of the shaft portions 43*a*, 44*a* of the disc shaft segments 43 and 44 through them at the 12:00 and 6:00 o'clock positions (FIG. 2). Shaft segment 43 is coupled to a flexible variable coupling 46. Shaft segment 44 is also coupled to a pointer 50. A hydraulic rotary actuator 49 is employed to turn the disc valve 33*a* via coupling 46 and shaft 43.

The disc valve member 33 is attached to shaft segments 43*a* and 44*a* by U-sectioned members 51 and 52, each having one or two belts or pins passing through apertures in them which are aligned with corresponding transverse apertures in the shaft sections.

There is a limit switch subassembly 47 of any available off-the-shelf type which is attached by means of bracket 48 to the step valve 33. This subassembly is coupled to control the solenoid-controlled valve or switch 40 which governs the application of the purified effluent to auxiliary ring 20 and tubing 37 to the grooves in the valve seat portions.

The turning of the shafts 43 and 44 is accomplished by any appropriate valve actuator or operator indicated schematically at 49. In turn, the latter is coupled to a master control panel that supervises the overall operation of the system 10.

The depth, shape and other dimensions of the grooves formed in the valve seat portions may be varied to suit the particular application of the invention. Likewise, the pressurized gas applied to these grooves need not be cooled effluent, but could alternatively be ambient air. If the latter is used directly, some loss of thermal efficiency could result, but this can be overcome by heating by passing it into heat-exchange relation with a part of the apparatus from which loss of heat has no effect on its overall thermal efficiency.

What is claimed is:

1. A valving system for controlling the flow of a first fluid through it in a predetermined direction, comprising:

(a) valve seat means;

(b) valve means having at least one side face having a predetermined portion thereof adapted to be moved into and out of substantial contact with a corresponding portion of said valve seat means;

(c) at least one of said predetermined portion of said side face of said valve means and said corresponding portion of said valve seat means having at least one recess, said at least one recess being substantially unobstructed when substantial contact is made between said valve means and said valve seat means;

at least one region being defined between said valve seat means and said side face of said valve means when said predetermined portion of said valve means is in substantial contact with said corresponding portion of said valve seat means, said at least one recess extending adjacent a substantial portion of said region; and (d) means for applying a flow of a second fluid to said at least one recess substantially perpendicular to said at least one side face of said valve means when said valve means is in its nominally closed position, said second fluid thereupon flowing in the region between said predetermined portion and said corresponding portion, said second fluid being at a higher pressure than said first fluid and thereby repelling said first fluid and preventing the latter from flowing through said region.

2. The system according to claim 1 wherein said first and second fluids are gases.

3. The system according to claim 2 wherein said first gas is not desired to flow through said region when said substantial contact is made and wherein said predetermined portion is a peripheral portion of said valve means, and further wherein said second gas is applied on opposite sides of said valve means.

4. The system according to claim 2 wherein said valve seat means includes at least one arcuate seat portion, at least one first recess being positioned in said arcuate seat portion, and wherein said valve means is substantially planar and has at least one corresponding arcuate peripheral portion adapted to be moved into or out of substantial contact with said arcuate seat portion, at least one second recess being positioned in said corresponding arcuate peripheral portion.

5. The system according to claim 4 wherein there are at least two arcuate seat portions which correspond to at least two arcuate peripheral portions.

6. The valving system according to claim 5 wherein said first recess comprises a groove formed in said arcuate seat portion and wherein said second recess in said valve means comprises a corresponding groove formed therein, said grooves being brought into substantial communication when said substantial contact is made.

7. The valving system according to claim 6 wherein said grooves have arcuate configurations.

8. The valving system according to claim 4 wherein said arcuate seat means portions and said arcuate peripheral portion of said planar valve have substantially semi-circular configurations.

9. The system according to claim 8 wherein there are at least two of said semi-circular arcuate seat portions and two of said semi-circular arcuate peripheral portions.

10. The system according to claim 1 wherein said valve seat means comprise two non-coplanar members.

11. The system according to claim 11 wherein said two non-coplanar members are spaced from one another in the direction of flow of fluid through said system.

12. The system according to claim 11 wherein said valve means comprise a substantially planar member and the two seat means are disposed on opposite sides thereof when said substantial contact is made.

13. The system according to claim 12 wherein said substantially planar valve member is a disc and said two seat members are arcuate ledges projecting inwardly from the valve walls and said planar valve member and said seat members have corresponding grooves which substantially mate when said substantial contact is made and wherein said second fluid is applied to said grooves when said substantial contact is made.

14. The system according to claim 1 with the addition of control means for applying said second fluid to said region substantially only when said substantial contact is made.

15. The system according to claim 14 wherein said control means is responsive to the movement of said valve means to predetermined positions.

16. The system according to claim 1 wherein the corresponding portion of said valve seat means has at least one first recess, the predetermined portion of said valve means including at least one second recess adapted to come into contact with said first recess when substantial contact is made between said valve means and said valve seat means.

17. An incineration system for gaseous effluents or the like comprising:

(a) at least one heat-exchange section;

(b) a high temperature combustion chamber in communication with said section;

(c) at least one duct means in communication with selected ones of said sections for conveying said effluents;

(d) at least one valve subassembly in said duct means, said subassembly comprising:

(i) valve seat means, (ii) valve means having at least one side face having a predetermined peripheral portion thereof adapted to be moved into and out of substantial contact with a corresponding portion of said valve seat means, (iii) at least one of said predetermined portion of said side face said valve means and said corresponding portion of said valve seat means having at least one recess, said at least one recess being substantially unobstructed when substantial contact is made between said valve means and said valve seat means, at least one region being defined between said valve seat means and said side face of said valve means when said predetermined portion of said valve means is in substantial contact with said corresponding portion of said valve seat means, said at least one recess extending adjacent a substantial portion of said region, and (iv) means for enabling a gas to flow into said at least one recess perpendicularly onto said at least one side face of said valve means in the region between said peripheral portion and said corresponding seat portion when said substantial contact is made, and (e) means for supplying to said enabling means when said substantial contact is made a substantially purified gas under pressure which prevents the flow of said effluent through said region.

18. The incineration system according to claim 17 wherein said (e) means includes:

(i) a source of said substantially purified gas, (ii) pump means coupled to said source for pumping said purified gas under pressure, and (iii) conduit means coupled to the output of said pump and to at least one passageway formed in the outer wall of said valve subassembly, and wherein said (d)(i) means includes at least one internal passageway for directing said gas to flow perpendicularly onto said valve means surface, said internal passageway communicating with the passageway formed in the outer wall of said valve subassembly.

19. In an incineration system for purifying gaseous effluents or the like which comprises at least one duct means in communication with a source of said effluents and with at least one heat-exchange section which is also in communication with a high temperature combustion chamber, said effluents normally passing through said duct means, said section and said chamber to exhaust, the combination comprising:

(a) at least one valve subassembly in said duct means, said subassembly including:

(i) valve seat means, (ii) valve means having at least one side face having a predetermined peripheral portion thereof adapted to be moved into and out of substantial contact with a corresponding portion of said valve seat means, (iii) at least one of said predetermined portion of said valve means and said face of said side corresponding portion of said valve seat means having at least one recess, said at least one recess being substantially unobstructed when substantial contact is made between said valve means and said valve seat means, at least one region being defined between said valve seat means and said side face of said valve means when said predetermined portion of said valve means is in substantial contact with said corresponding portion of said valve seat means, said at least one recess extending adjacent a substantial portion of said region, and (iv) means for enabling a gas to flow into said at least one recess perpendicularly onto said at least one side face of said valve means in the region between said peripheral portion and said corresponding seat portion when said substantial contact is made, and (b) means for supplying to said enabling means when said substantial contact is made a substantially purified gas under pressure which prevents the flow of said effluent through said region.

20. In an incineration system according to claim 19 wherein said (b) means includes:

(i) a source of said substantially purified gas, (ii) pump means coupled to said source for pumping said purified gas under pressure, and (iii) conduit means coupled to the output of said pump and to at least one passageway formed in the outer wall of said valve subassembly, said passageway communicating with said valve seat means, and further wherein said (a)(i) means comprises two internal passageways for directing said gas onto respectively opposite surfaces of said valve means, said internal passageways communicating with two respective ones of said passageways formed in the outer wall of said valve subassembly.

* * * * *